US010370839B2

(12) United States Patent
Kashirajima et al.

(10) Patent No.: US 10,370,839 B2
(45) Date of Patent: Aug. 6, 2019

(54) FLUSH TOILET

(71) Applicant: TOTO LTD., Kitakyushu-shi, Fukuoka (JP)

(72) Inventors: Shu Kashirajima, Kitakyushu (JP); Masaaki Momoe, Kitakyushu (JP); Yuuki Shinohara, Kitakyushu (JP); Eiji Shiohara, Kitakyushu (JP); Naoto Matsuo, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/710,933

(22) Filed: Sep. 21, 2017

(65) Prior Publication Data

US 2018/0087255 A1 Mar. 29, 2018

(30) Foreign Application Priority Data

Sep. 23, 2016 (JP) ..... 2016-185929

(51) Int. Cl.
*E03D 11/08* (2006.01)
*E03D 11/06* (2006.01)

(52) U.S. Cl.
CPC ..... *E03D 11/06* (2013.01); *E03D 11/08* (2013.01); *E03D 2201/40* (2013.01)

(58) Field of Classification Search
CPC ..... E03D 11/08; E03D 11/13; E03D 11/02; E03D 2201/40
USPC ..... 4/420, 421, 428
See application file for complete search history.

(56) References Cited

U.S. PATENT DOCUMENTS

| | | | | |
|---|---|---|---|---|
| 7,661,153 | B2 * | 2/2010 | Nakamura | E03D 11/08 4/420 |
| 2006/0005310 | A1 | 1/2006 | Nakamura et al. | |
| 2015/0197928 | A1 * | 7/2015 | McHale | E03D 11/02 4/423 |

FOREIGN PATENT DOCUMENTS

| | | | |
|---|---|---|---|
| JP | 2006-104936 | A | 4/2006 |
| JP | 2011-231472 | A | 11/2011 |
| JP | 2015-183485 | A | 10/2015 |
| JP | 2015-196960 | A | 11/2015 |
| JP | 2016-501326 | A | 1/2016 |

OTHER PUBLICATIONS

An Office Action mailed by the Japanese Patent Office dated Jan. 10, 2019, which corresponds to Japanese Patent Application No. 2016-185929 and is related to U.S. Appl. No. 15/710,933.

* cited by examiner

*Primary Examiner* — Erin Deery
*Assistant Examiner* — Nicholas A Ros
(74) *Attorney, Agent, or Firm* — Studebaker & Brackett PC

(57) ABSTRACT

A flush toilet includes: a bowl including a rim formed on the top edge of a bowl-shaped waste receiving surface, a discharge path connected to the bottom of this bowl for discharging waste, and a rim spout portion disposed on this rim for spouting flush water within the bowl to form a circulating flow. The bowl further includes a shelf, formed in the circumferential direction from the rim spout portion between the waste receiving surface top edge and the rim bottom end, for guiding flush water spouted from the rim spout portion in the circumferential direction. The rim spout portion is disposed on either the left or right of either the side region or the front region of the bowl, and forms a rim spout port to spout flush water rearward. The width of the shelf is set to decrease from the side to the rear of the bowl.

4 Claims, 18 Drawing Sheets

FLUSH TOILET

TECHNICAL FIELD

The present invention relates to a flush toilet, and more particularly to a flush toilet configured to discharge waste by flushing the flush toilet with flush water supplied from a flush water source.

BACKGROUND

For some time, known flush toilets flushed with flush water supplied from a flush water source to discharge waste have included those in which, as set forth for example in Patent Document 1 (Japanese Patent Unexamined Publication No. 2016-501326), a single rim spout port is disposed on the rear side of a rim, and flush water is spouted forward from this rim spout port to form a circulating flow.

In conventional flush toilets of this type, at the back portion of the bowl the curvature radius of a curved surface in a lower connecting surface connecting the top edge of a waste receiving surface and the inside edge of a shelf, and the curvature radius of a curved surface connecting the outside edge of the shelf and the bottom end of a rim, are both set to be relatively large. The slope angle of the shelf relative to a horizontal plane is also set to be relatively large.

In the conventional flush toilet set forth in Patent Document 2 (Japanese Patent Unexamined Publication No. 2015-196960), a first rim spout port is formed slightly to the rear side of the side center portion of the bowl, and a second rim spout port is disposed on the rear side of the bowl, such that flush water is spouted toward the front from this first rim spout port and second rim spout port, respectively.

In the rear portion of the bowl in such conventional flush toilets, as well, the curvature radius of the curved surface in the connecting surface connecting the top edge of the waste receiving surface and the inside edge of the shelf are set to be relatively large.

In the conventional flush toilets set forth in the above-described Patent Documents 1 and 2, waste adhering to the rear region inside the bowl is flushed out by flush water reaching the rear region inside the bowl after rim spout water spouted forward from the rim spout port has circulated in the front region inside the bowl.

However, in the above-described conventional flush toilet set forth in Patent Documents 1 and 2, when rim spout water spouted forward from the rim spout port reaches the rear region inside the bowl after circulating in the front region inside the bowl, the force of the flush water is weakened. The problem thus arises that in some cases the rear region of the bowl, to which waste easily adheres, cannot be sufficiently washed down.

In recent years, with the diversification of flush toilet designs, there has been a growing need to plan for visual simplicity in the appearance of the toilet main unit bowl interior or the rim inside perimeter side, by placing items such as the rim spout port or the rim conduit relative to the rim so that the rim spout port or the upstream side rim conduit is invisible to the user, and by designing so that water is spouted rearward from a single rim spout port.

However, in such a flush toilet for spouting water rearward from a rim spout port, the issue is how to increase flushing performance while limiting the volume of flush water required for flushing, so as to reliably wash off the rear region of the bowl where waste can easily adhere.

SUMMARY

The present invention was undertaken to solve the above-described issues, and has the object of providing a flush toilet capable of sufficiently washing down the rear region in a bowl where waste can easily adhere, and which is difficult to flush, and capable of improving flushing performance.

To solve the above-described problems, the present invention is a flush toilet configured to discharge waste by flushing the flush toilet with flush water supplied from a flush water source, the flush toilet comprising: a bowl which includes a rim formed at a top edge of the bowl, a bowl-shaped waste receiving surface, and a shelf formed between the bowl-shaped waste receiving surface and the rim; a discharge path configured to discharge waste, the discharge path being connected to a bottom of the bowl; and a rim spout portion disposed on the rim, the rim spout portion being configured to spout the flush water onto the shelf in the bowl so as to form a circulating flow; wherein the shelf is formed between a top edge of the waste receiving surface and a bottom end of the rim and in a circumferential direction from the rim spout portion, the shelf being configured to guide the flush water spouted from the rim spout portion in the circumferential direction; the rim spout portion includes a rim spout port disposed on either a left or right of either a side region or a front region of the bowl, the rim spout port being configured to spout flush water rearward; and a width of the shelf is set to decrease from a side to a rear of the bowl.

According to the invention thus constituted, flush water spouted to the rear from a rim spout port in a rim spout portion disposed on either the left or right rim of the side region or the front region of the bowl is directed in the circumferential direction of the bowl by flowing over a shelf, thereby forming a circulating flow. At this time, the width of the shelf is set to decrease from the side to the rear of the bowl. Thus when flush water spouted rearward from the rim spout port hits the shelf from the side of the bowl, it can flow smoothly from the relatively narrow width shelf into the rear region within the bowl.

Therefore in the rear region inside the bowl where waste easily adheres and flushing off is difficult, wash down can be sufficiently performed, and flushing performance can be improved.

In the present invention, preferably, the bowl further includes an outside connecting surface configured to connect between an outside edge of the shelf and the bottom end of the rim by a curved surface, and a curvature radius of the curved surface of the outside connecting surface in a vertical direction is set to increase from the side to the rear of the bowl.

According to the invention thus constituted, when flush water spouted from the rim spout port rearward hits the rear outside connecting surface from the side of the bowl, it can flow smoothly from the shelf, which has a relatively large curvature radius in the vertical direction of the outside connecting surface curved surface, and a relatively narrow width, into the rear region inside the bowl.

Therefore in the rear region inside the bowl where waste easily adheres and flushing off is difficult, wash down can be sufficiently performed, and flushing performance can be effectively improved.

In the present invention, preferably, the curvature radius in the vertical direction of the outside connecting surface at a position which is left-right symmetrical to a center of the bowl is set so that one region in which the rim spout port is formed within the side region of the bowl is larger than other side region in which the rim spout port is not formed.

According to the invention thus constituted, when flush water spouted rearward from the rim spout port hits the rear from a region on one side of the bowl side region, it is able to flow smoothly from the relatively narrow width shelf into the rear region inside the bowl. Therefore in the rear region inside the bowl where waste easily adheres and flushing off is difficult, wash down can be sufficiently performed, and flushing performance can be more effectively improved.

In the present invention, preferably, the bowl further includes an outside connecting surface configured to connect between the bottom end of the rim and an outside edge of the shelf by a curved surface, and a curvature radius of the curved surface of the outside connecting surface in a vertical direction is set to be essentially constant from the side to the rear of the bowl.

According to the invention thus constituted, when flush water spouted from the rim spout port rearward hits the rear outside connecting surface from the side of the bowl, it can flow smoothly from the shelf, which has an essentially constant curvature radius in the vertical direction of the outside connecting surface curved surface, and a relatively narrow width, into the rear region inside the bowl.

Therefore in the rear region inside the bowl where waste easily adheres and flushing off is difficult, wash down can be sufficiently performed while maintaining bowl size, and flushing performance can be effectively improved.

In the present invention, preferably, the bowl further includes an inside connecting surface configured to connect between an inside edge of the shelf and the top edge of the waste receiving surface by a curved surface, and a curvature radius of the curved surface of the inside connecting surface in the vertical direction is set to increase from the side to the rear of the bowl.

According to the invention thus constituted, when flush water spouted from the rim spout port rearward hits the rear inside connecting surface from the side of the bowl, it can flow smoothly from the shelf, which has a relatively large curvature radius in the vertical direction of this inside connecting surface curved surface, and a relatively narrow width, into the rear region inside the bowl.

Therefore in the rear region inside the bowl where waste easily adheres and flushing off is difficult, wash down can be sufficiently performed, and flushing performance can be more reliably improved.

In the present invention, preferably, the shelf includes a sloped surface sloping downward from an outside toward an inside of the bowl, and a slope angle of the sloped surface is set to increase from the side to the rear of the bowl.

According to the invention thus constituted, when flush water spouted rearward from the rim spout port hits the rear shelf sloped surface from the side of the bowl, it is able to flow smoothly from the shelf, which has a relatively large sloped surface and relatively small width shelf, into the rear region within the bowl. Therefore in the rear region inside the bowl where waste easily adheres and flushing off is difficult, wash down can be sufficiently performed, and flushing performance can be more reliably improved.

According to the flush toilet of the present invention, in the rear region inside the bowl where waste easily adheres and flushing off is difficult, wash down can be sufficiently performed, and flushing performance can be improved.

DETAILED DESCRIPTION

Next, referring to FIGS. 1 through 10, a flush toilet according to a first embodiment of the invention is explained as follows.

Figure 1:
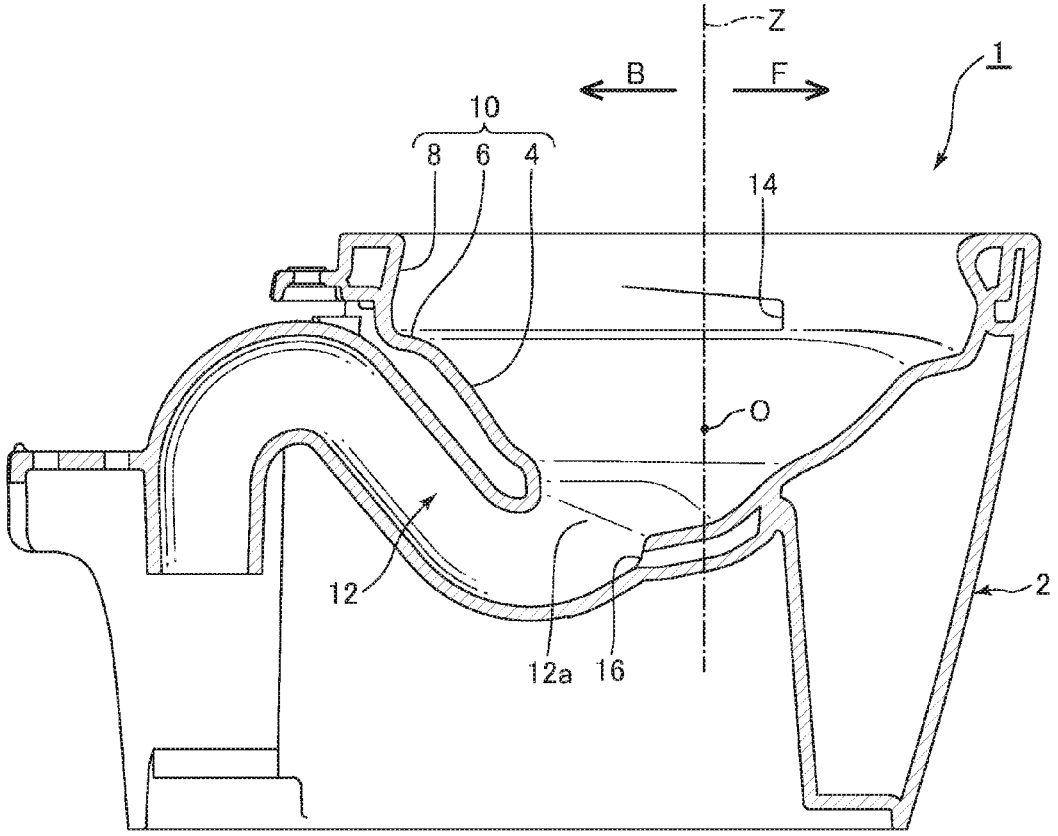
FIG. 1 is a center cross section of the main unit of a flush toilet according to a first embodiment of the invention.
Figure 2:
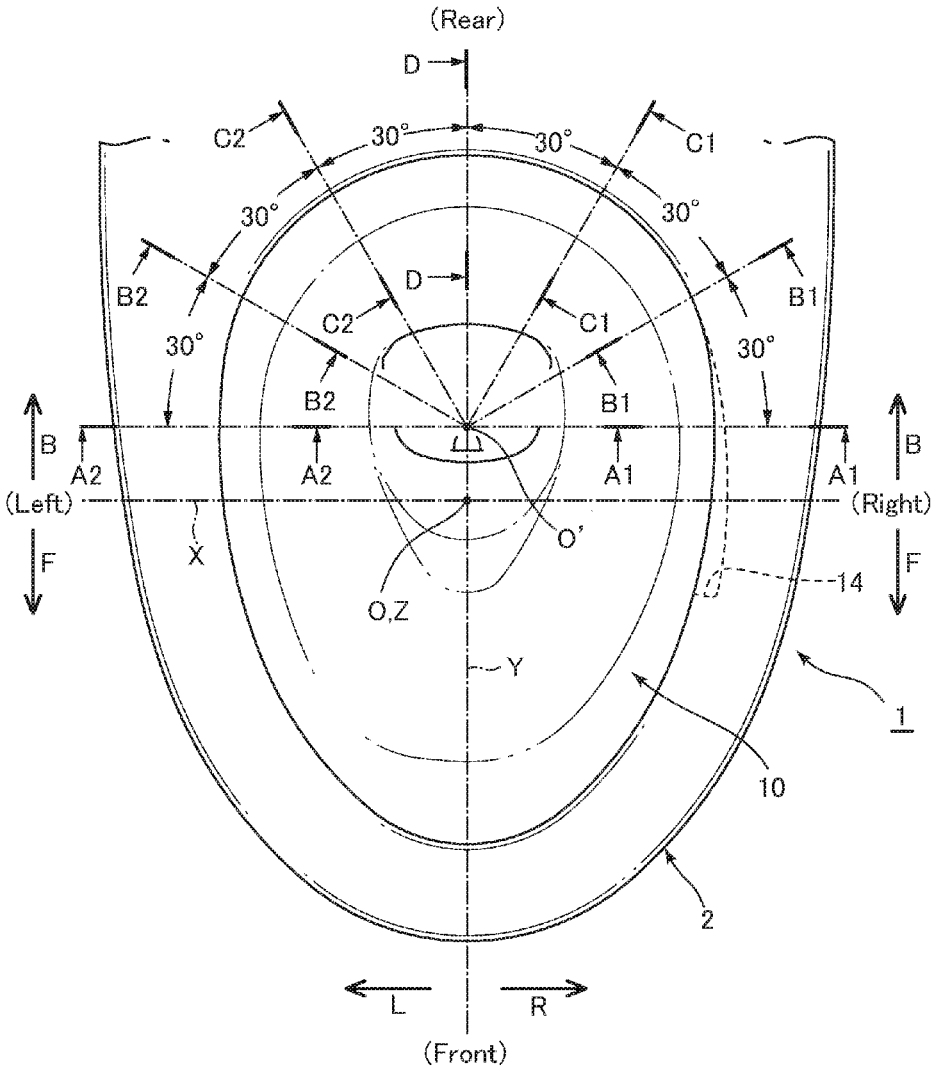
FIG. 2 is a plan view of the main unit of the flush toilet according to the first embodiment of the invention.

First, FIG. 1 is a center cross section of the main unit of a flush toilet according to a first embodiment of the invention. FIG. 2 is a plan view of the main unit of the flush toilet according to the first embodiment of the invention. Furthermore, FIG. 3 is a perspective view seen diagonally from the rear of the flush toilet main unit according to the first embodiment of the invention.

Figure 3:
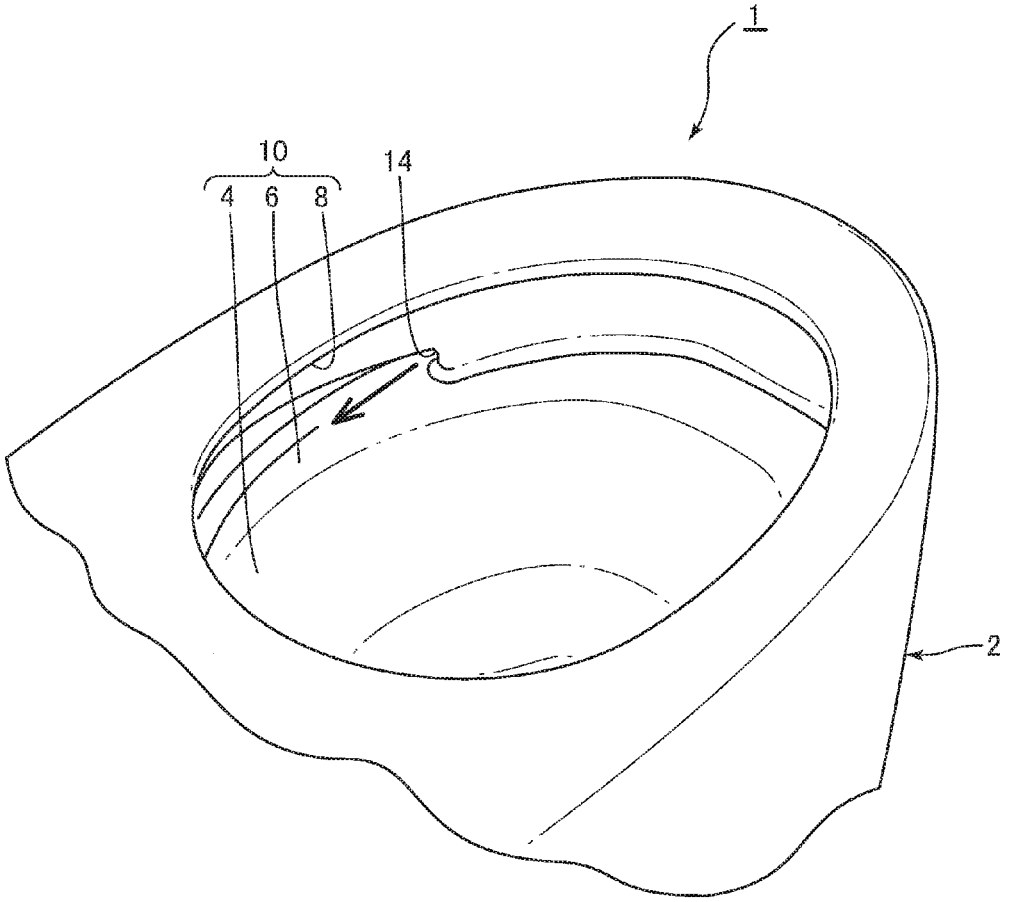
FIG. 3 is a perspective view seen diagonally from the rear of the flush toilet main unit according to the first embodiment of the invention.

As shown in FIGS. 1-3, the flush toilet 1 according to the first embodiment of the invention includes a ceramic toilet body 2.

Note that in the flush toilet 1 of the embodiment shown in FIGS. 1-3, a toilet seat and toilet lid (not shown) are disposed on the top surface of the toilet main unit 2. A sanitary flush portion for washing a user's private parts, and functional portions such as the water supply system involved in the water supply function to the toilet main unit 2, are installed on the rear side of this toilet seat and toilet lid. However these are not illustrated, and an explanation thereof is here omitted.

As shown in FIGS. 1-3, the toilet main unit 2 includes a bowl made up of a bowl-shaped waste receiving surface 4, a shelf 6, and a rim 8. The shelf 6 is formed on the top edge of the waste receiving surface 4. The rim 8 is formed so as to rise from the top edge of this shelf 6.

In addition, as shown in FIG. 1, the toilet main unit 2 includes a discharge trap pipe 12.

An inlet 12*a* on this discharge trap pipe 12 is connected to the bottom of the bowl 10, and serves as a discharge route for discharging waste in the bowl 10.

Here, in the flush toilet 1 according to the first embodiment of the present invention shown in FIGS. 1 and 2, the center axis in the horizontal left-right direction of the toilet main unit 2 bowl 10 as seen in plan view is indicated by an "X," the center axis in the horizontal front-back direction thereof is indicated by a "Y," and the center axis in the vertical direction passing through the center O of the bowl 10 is indicated by a "Z."

As shown in FIG. 2, the front, rear, left, and right directions of the flush toilet 1 are respectively indicated as "front," "rear," "left," and "right."

And, as shown in FIGS. 1 and 2, a "front side region F" and "rear side region B" are respectively defined for the front and rear sides relative to the center O, the horizontal left-right direction center axis X, and the vertical direction center axis Z of the bowl 10 of the flush toilet 1.

In addition, as shown in FIG. 2, a "left side region L" and "right side region R" are respectively defined for the left and right sides, as seen from the front, relative to the center O and the horizontal front-back direction center axis Y of the bowl 10 of the flush toilet 1.

Next, as shown in FIGS. 1-3, the rim 8 on either the left or right inside the front region F of the bowl 10, i.e., on the inside perimeter side of the 8 in the right side region R within the front region F of the bowl 10 as seen from the front of the toilet main unit 2, a single rim spout port 14 is formed as part of the rim spout portion, and forms a circulating flow by spouting flush water rearward into the bowl 10. I.e., this single rim spout port 14 is the sole rim spout port disposed in a part of the front region F and the right side region R over the entire perimeter on the inside perimeter side of the rim 8.

The rim conduit (not shown) on the upstream side of the rim spout port 14 is formed on the interior of the rim 8. Also, the upstream side of this rim conduit (not shown) is connected via a water utility pipe (not shown) or the like to a water utility (not shown) or the like serving as flush water source.

In addition, the bowl 10 shelf 6 is formed in the circumferential direction on the downstream side starting from the rim spout port 14. By this means, flush water spouted (rim spouted) from the rim spout port 14 rearward is guided in the circumferential direction over the shelf 6.

Note that in the flush toilet 1 of the present embodiment, a form is explained in which the rim spout port 14 is formed on the inside perimeter side of the rim 8 on the right side within the front region F of the bowl 10 as seen from the front of the toilet main unit 2. Without such limitation, however, any form is acceptable so long as the single rim spout port 14 is disposed on the rim 8 on either the left or right of either the side region or the front region F of the bowl 10, and water is spouted (rim spouted) from the rim spout port 14 rearward.

In addition, as shown in FIG. 1, a jet spout port 16 is formed at the bottom portion of the bowl 10. This jet spout port 16 is directed toward the inlet 12*a* of the discharge trap pipe 12. In this way, spouting (jet spouting) from a water supply functional portion (not shown) is also effected from this jet spout port 16.

Also, in the flush toilet 1 according to the present embodiment, rim spouting by the rim spout port 14 is performed using water utility supply pressure. A "hybrid" form of flush toilet is explained in which flush water is supplied into a reservoir tank (not shown) by controlling a pressurizing pump (not shown) for jet spouting by the jet spout port 16. Without limit to this form, however, the invention may also be applied to other forms. A form is also acceptable in which jet spouting by the jet spout port 16 is omitted.

Next, referring to FIGS. 1-10, the parts from the top edge of the waste receiving surface 4 to the rim 8 of the bowl 10 in the flush toilet 1 according to the first embodiment of the invention is explained in detail.

Figure 4:
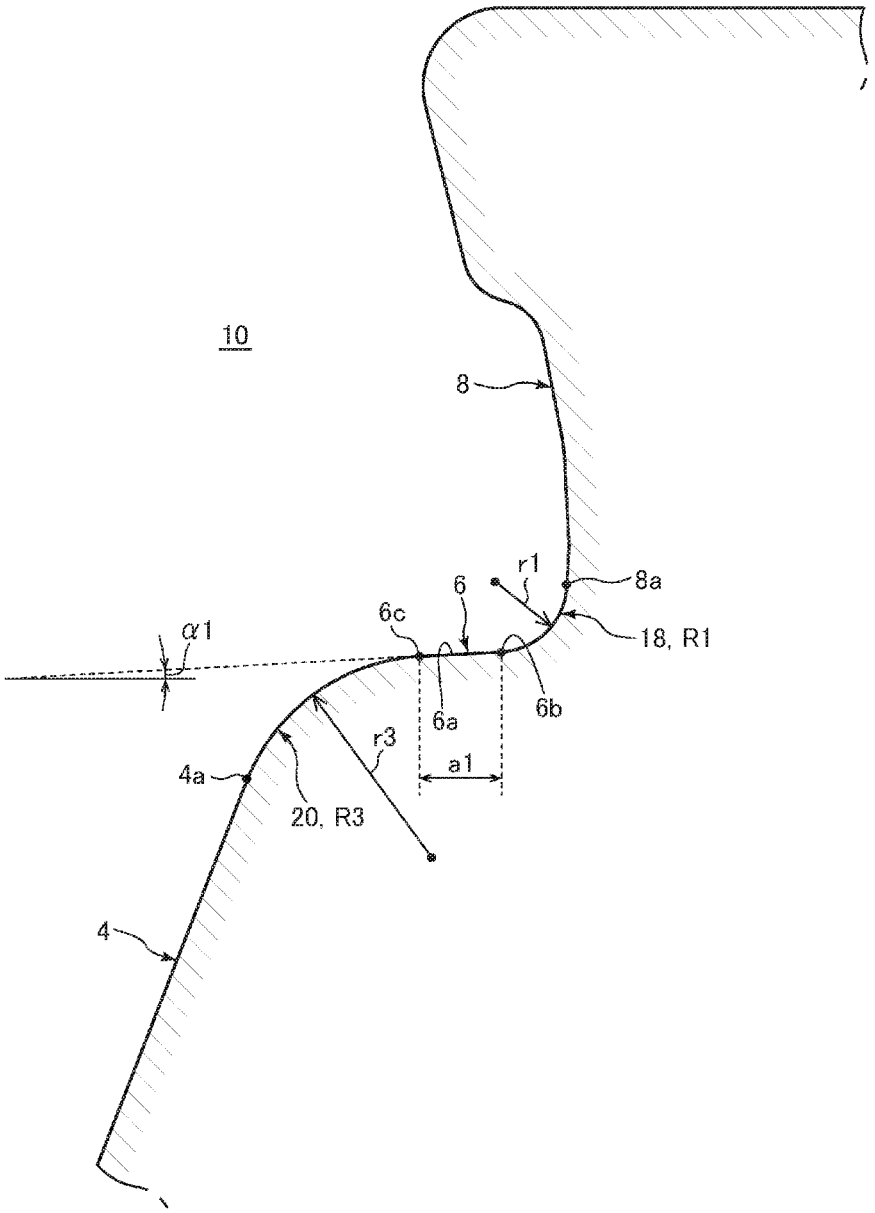
FIG. 4 is a cross section through line A1-A1 in FIG. 2.
Figure 5:
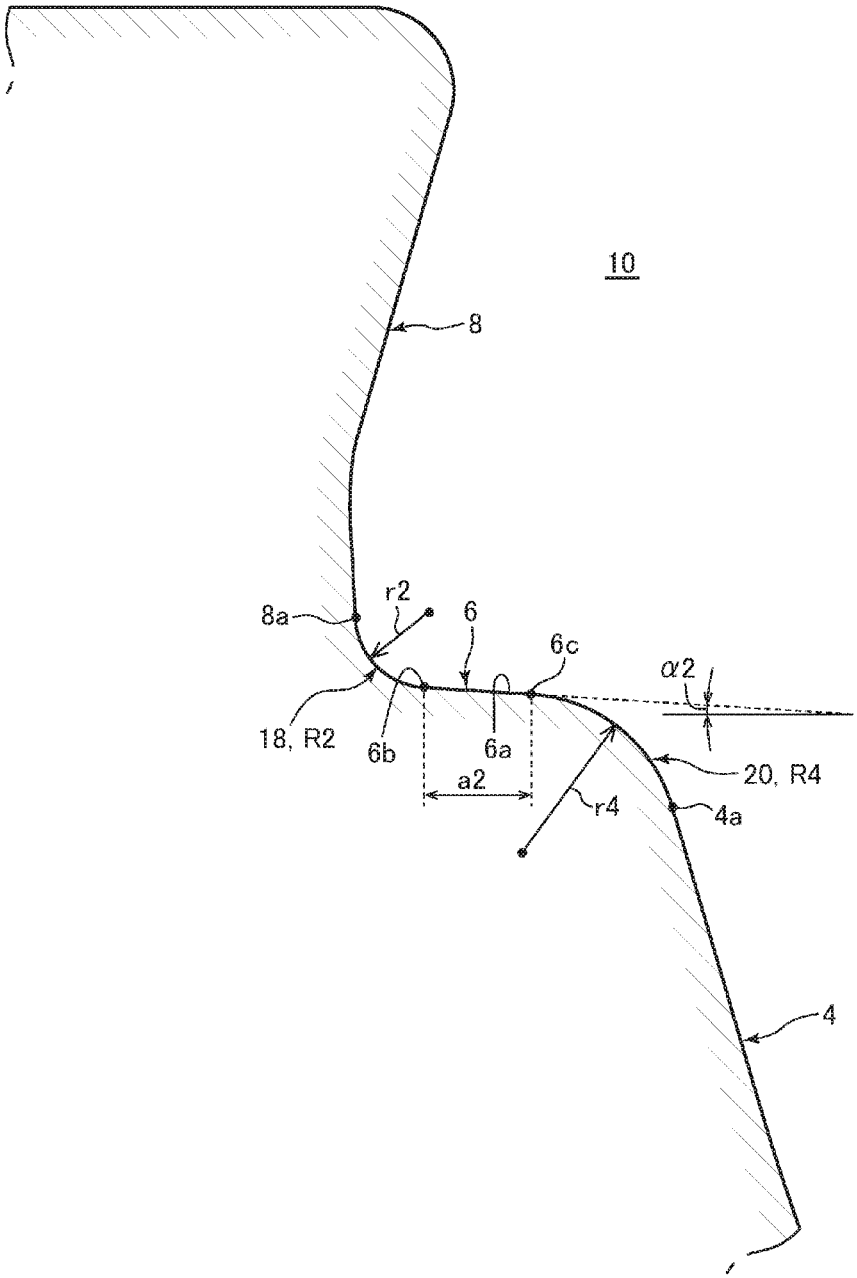
FIG. 5 is a cross section through line A1-A2 in FIG. 2.

First, FIG. 4 is a cross section (cross section A1-A1) through line A1-A1 in FIG. 2. FIG. 5 is a cross section (cross section A2-A2) through line A2-A2 in FIG. 2.

Figure 6:
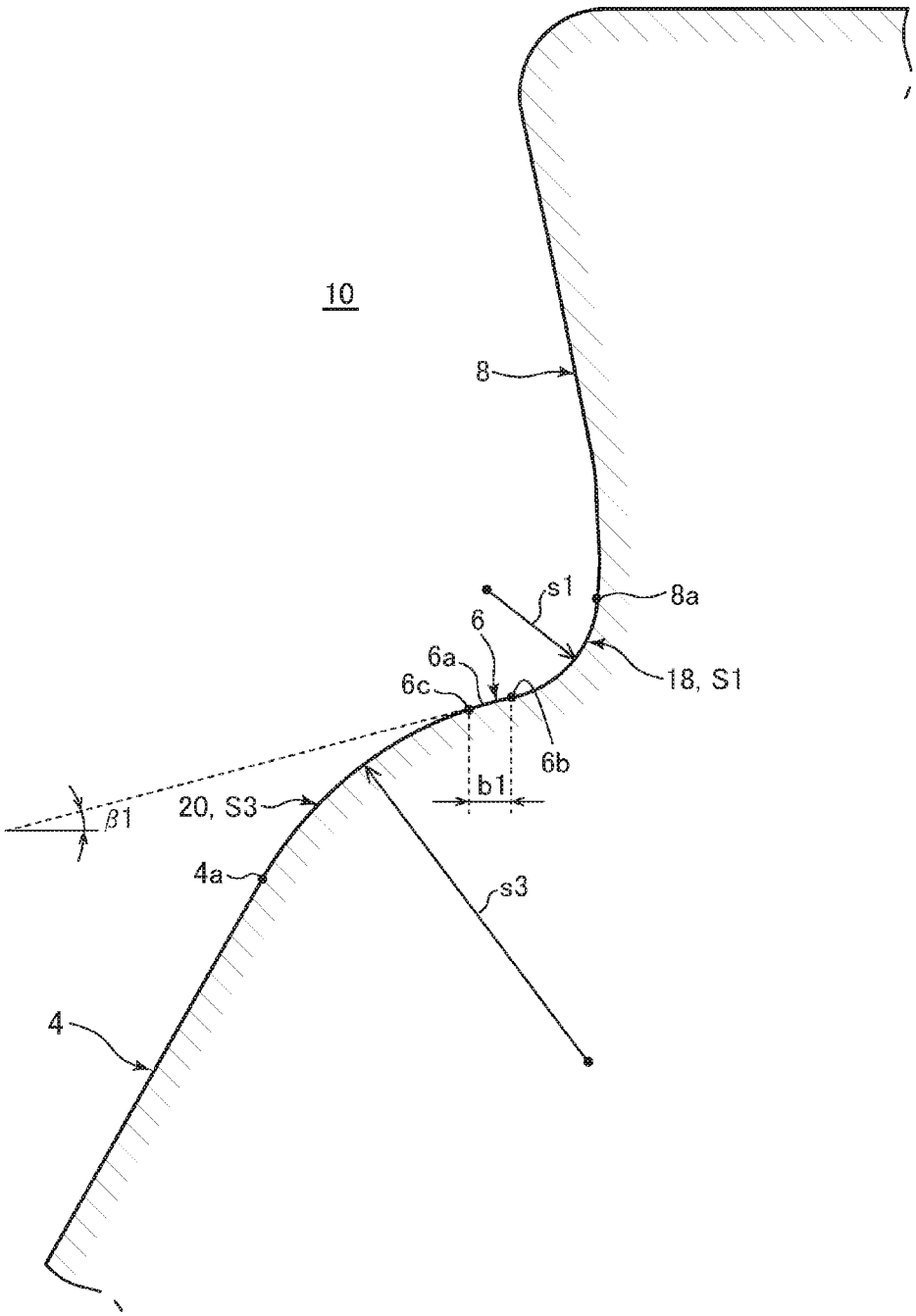
FIG. 6 is a cross section through line B1-B1 in FIG. 2.
Figure 7:
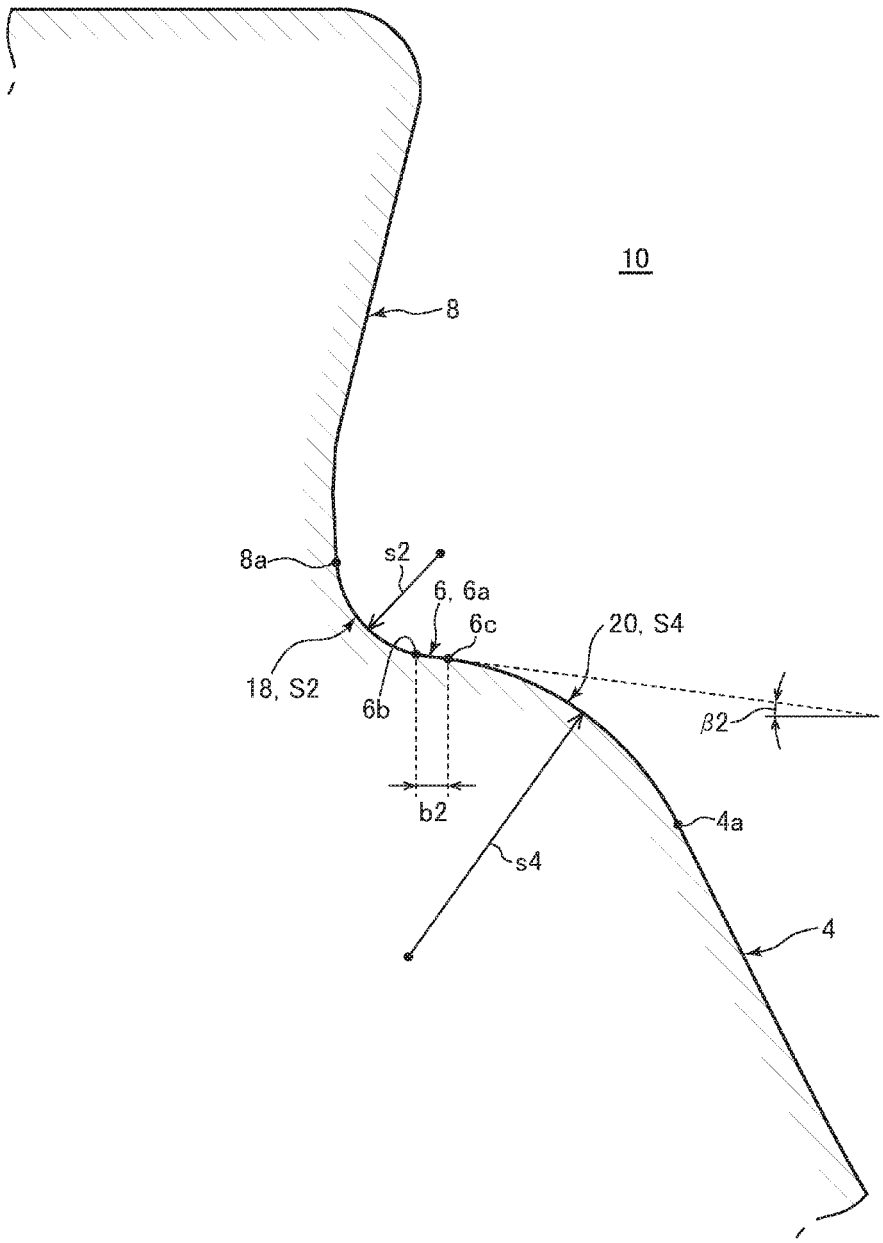
FIG. 7 is a cross section through line B2-B2 in FIG. 2.

Next, FIG. 6 is a cross section (cross section B1-B1) through line B1-B1 in FIG. 2. Also, FIG. 7 is a cross section (cross section B2-B2) through line B2-B2 in FIG. 2.

Figure 8:
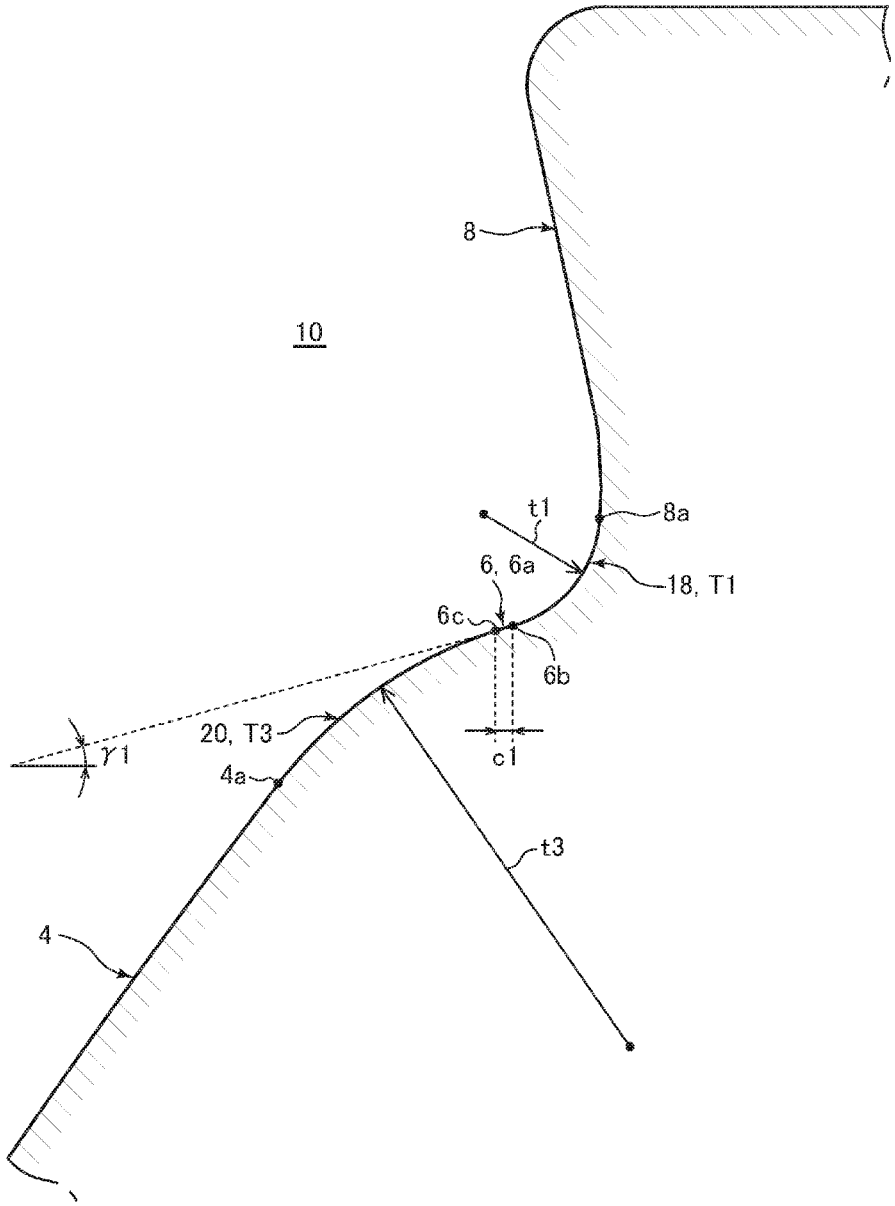
FIG. 8 is a cross section through line C1-C1 in FIG. 2.
Figure 9:
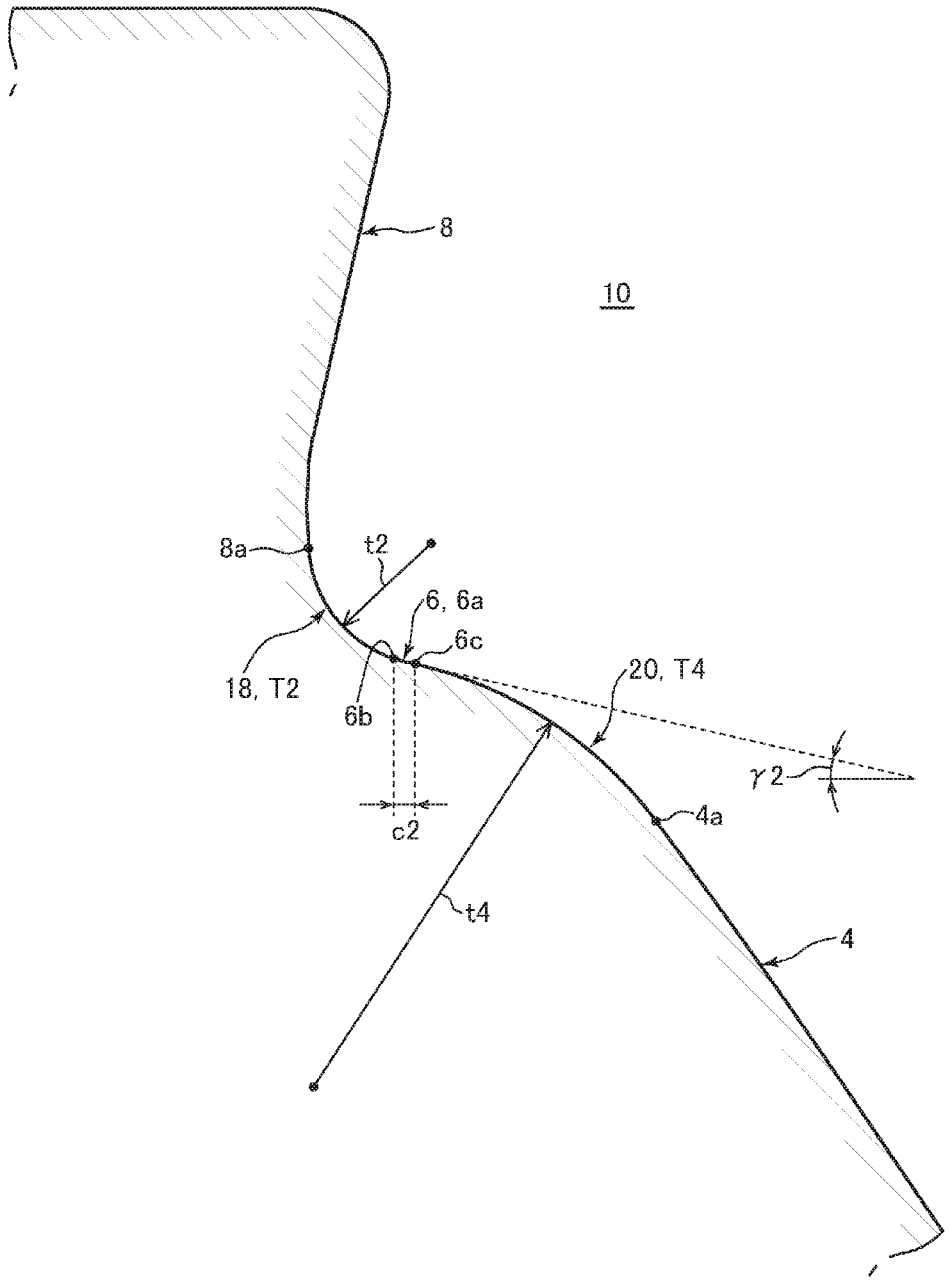
FIG. 9 is a cross section through line C2-C2 in FIG. 2.

In addition, FIG. 8 is a cross section (cross section C1-C1) through line C1-C1 in FIG. 2. FIG. 9 is a cross section (cross section C2-C2) through line C2-C2 in FIG. 2.

Figure 10:
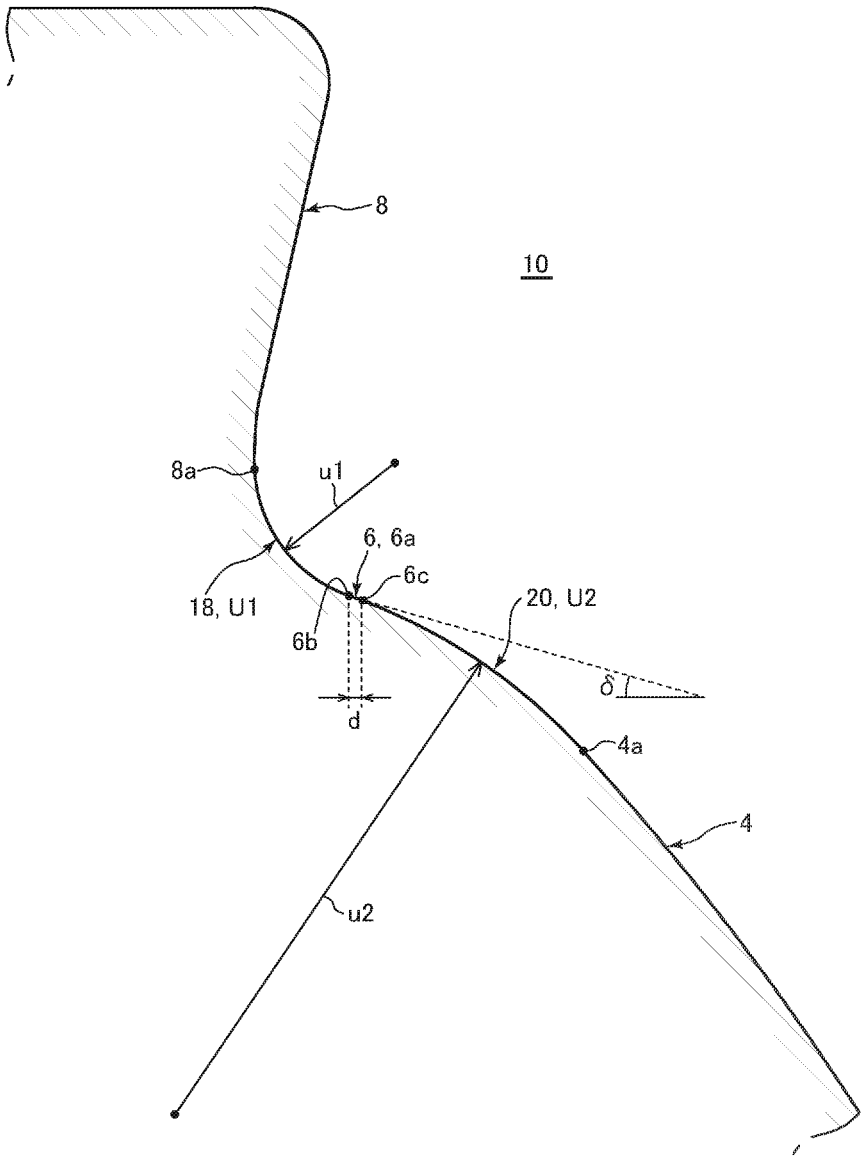
FIG. 10 is a cross section through line D-D in FIG. 2.

FIG. 10 is a cross section (cross section D-D) through line D-D in FIG. 2.

In this embodiment, the cross sections through B1-B1 and C1-C1 shown in FIGS. 6 and 8, respectively, are partial cross sections of the rear region B of the bowl 10, respectively offset by 30° and 60° in the left circumferential direction centered on a point O' at the predetermined distance behind the center O of the bowl 10 from the cross section through line A1-A1 in the toilet main unit 2 seen in plan view in FIG. 2.

The B2-B2 cross section shown in FIG. 7, the C2-C2 cross section shown in FIG. 9, and the D-D cross section shown in FIG. 10 are partial cross sections of the rear region B of the bowl 10 respectively rotated by 30°, 60°, and 90° in the right circumferential direction around the point O' of the bowl 10 from the cross section along line A2-A2 in FIG. 2 as seen in the plan view shown in FIG. 2.

First, as shown in FIGS. 1-10, the shelf 6 includes a sloped surface 6*a* sloping downward from the outside toward the inside within the bowl 10. By so doing, the various slope angles $\alpha 1$, $\alpha 2$, $\beta 1$, $\beta 2$, $\gamma 1$, $\gamma 2$, and $\delta$ of each of the sloped surfaces 6*a* of the shelf 6 shown in FIGS. 4-10 are set to increase as the position moves from the side to the rear of the bowl 10 ($\alpha 1<\beta 1<\gamma 1\leq\delta$; $\alpha 2<\beta 2<\gamma 2<\delta$).

Here, an angle of, for example, preferably 1° to 15°, and more preferably 2°-7°, is set as the slope angle $\alpha 1$ for the sloped surface 6*a* of the shelf 6 shown in FIG. 4.

An angle of, for example, preferably 1° to 15°, and more preferably 2°-7°, is set as the slope angle $\alpha 2$ for the sloped surface 6*a* of the shelf 6 shown in FIG. 5.

Furthermore, an angle of, for example, preferably 3° to 30°, and more preferably 10°-20°, is set as the slope angle $\beta 1$ for the sloped surface 6*a* of the shelf 6 shown in FIG. 6.

An angle of, for example, preferably 2° to 25°, and more preferably 7°-17°, is set as the slope angle $\beta 2$ for the sloped surface 6*a* of the shelf 6 shown in FIG. 7.

Furthermore, an angle of, for example, preferably 10° to 40°, and more preferably 15°-30°, is set as the slope angle $\gamma 1$ for the sloped surface 6*a* of the shelf 6 shown in FIG. 8.

An angle of, for example, preferably 3° to 30°, and more preferably 10°-20°, is set as the slope angle $\gamma 2$ for the sloped surface 6*a* of the shelf 6 shown in FIG. 9.

Furthermore, an angle of, for example, preferably 10° to 40°, and more preferably 15°-30°, is set as the slope angle $\delta$ for the sloped surface 6*a* of the shelf 6 shown in FIG. 10.

As shown in FIGS. 2, 4, and 5, of the slope angles $\alpha 1$ and $\alpha 2$ of the sloped surface 6*a* of the shelf 6 at left-right symmetrical positions relative to the center O of the bowl 10, the slope angle $\alpha 1$ (e.g., $\alpha 1$=3.6°) of the sloped surface 6*a* of the shelf 6 in the region on one side where the rim spout port 14 is formed inside the bowl 10 side region (the right side region R as seen from the front of the toilet main unit 2) is set to be larger than the slope angle $\alpha 2$ (e.g., $\alpha 2$=3.1°) of the sloped surface 6*a* of the shelf 6 in the region on the other side where the rim spout port 14 is not formed (the left side region L as seen from the front of the toilet main unit 2) ($\alpha 1>\alpha 2$).

Similarly, as shown in FIGS. 6 and 7, of the slope angles $\beta 1$ and $\beta 2$ of the sloped surface 6*a* of the shelf 6 at left-right symmetrical positions relative to the center O of the bowl 10, the slope angle $\beta 1$ (e.g., $\beta 1$=15°) of the sloped surface 6*a* of the shelf 6 in the region on one side where the rim spout port 14 is formed inside the bowl 10 side region (the right side region R as seen from the front of the toilet main unit 2) is set to be larger than the slope angle β2 (e.g., β2=12°) of the sloped surface 6*a* of the shelf 6 in the region on the other side where the rim spout port 14 is not formed (the left side region L as seen from the front of the toilet main unit 2) (β1>β2).

Similarly, as shown in FIGS. 8 and 9, of the slope angles γ1 and γ2 of the sloped surface 6*a* of the shelf 6 at left-right symmetrical positions relative to the center O of the bowl 10, the slope angle γ1 (e.g., γ1=22°) of the sloped surface 6*a* of the shelf 6 in the region on one side where the rim spout port 14 is formed inside the bowl 10 side region (the right side region R as seen from the front of the toilet main unit 2) is set to be larger than the slope angle γ2 (e.g., γ2=14°) of the sloped surface 6*a* of the shelf 6 in the region on the other side where the rim spout port 14 is not formed (the left side region L as seen from the front of the toilet main unit 2) (γ1>γ2).

The shelf 6 widths a1, a2, b1, b2, c1, c2 and d corresponding to the cosine component lengths of each sloped surface 6*a* of the shelf 6 shown in FIGS. 4-10 are set to decrease from the side to the rear of the bowl 10 (a1>b1>c1≥d; a2>b2>c2>d).

Here the width a1 of the shelf 6 shown in FIG. 4 is preferably set, for example, at 5 mm-25 mm, and more preferably at 5 mm-15 mm.

Here the width b1 of the shelf 6 shown in FIG. 6 is preferably set, for example, at 2 mm-20 mm, and more preferably at 3 mm-13 mm.

Furthermore, the width c1 of the shelf 6 shown in FIG. 8 is preferably set, for example, at 0 mm-10 mm, and more preferably at 0 mm-5 mm.

Also, the width d of the shelf 6 shown in FIG. 10 is preferably set, for example, at 0 mm-10 mm, and more preferably at 0 mm-5 mm.

In addition, the width a2 of the shelf 6 shown in FIG. 5 is preferably set, for example, at 5 mm-35 mm, and more preferably at 5 mm-25 mm.

In addition, the width b2 of the shelf 6 shown in FIG. 7 is preferably set, for example, at 5 mm-25 mm, and more preferably at 5 mm-15 mm.

Furthermore, the width c2 of the shelf 6 shown in FIG. 9 is preferably set, for example, at 2 mm-20 mm, and more preferably at 3 mm-13 mm.

Next, as shown in FIGS. 4-10, the bowl 10 further includes an outside connecting surface 18 which connects between the bottom end 8*a* of the rim 8 and the outside edge 6*b* of the shelf 6 using curved surfaces R1, R2, S1, S2, T1, T2, and U1. The vertical curvature radii r1, r2, s1, s2, t1, t2, and u1 of the curved surfaces R1, R2, S1, S2, T1, T2 and U1 of this outside connecting surface 18 as seen in vertical elevation are set to increase from the side toward the rear of the bowl 10 (r1<s1<t1≤u1; r2<s2<t2<u1).

Here the curvature radius r1 shown in FIG. 4 is preferably set, for example, at 2 mm-15 mm, and more preferably at 5 mm-10 mm.

Also, the curvature radius s1 shown in FIG. 6 is preferably set, for example, at 5 mm-20 mm, and more preferably at 7 mm-15 mm.

In addition, the curvature radius t1 shown in FIG. 8 is preferably set, for example, at 8 mm-30 mm, and more preferably at 10 mm-25 mm.

Also, the curvature radius u1 shown in FIG. 10 is preferably set, for example, at 8 mm-40 mm, and more preferably at 10 mm-25 mm.

In addition, the curvature radius r2 shown in FIG. 5 is preferably set, for example, at 2 mm-5 mm, and more preferably at 5 mm-10 mm.

Also, the curvature radius s2 shown in FIG. 7 is preferably set, for example, at 5 mm-20 mm, and more preferably at 7 mm-15 mm.

In addition, the curvature radius t2 shown in FIG. 9 is preferably set, for example, at 8 mm-25 mm, and more preferably at 10 mm-20 mm.

Next, as shown in FIGS. 2, 4, and 5, of the curvature radii r1 and r2 of the curved surfaces R1 and R2 of the outside connecting surface 18 at a position which is left-right symmetrical to the center O of the bowl 10, the curvature radius r1 (e.g., r1=8 mm) in the region on the side where the rim spout port 14 is formed within the side region the bowl 10 (the right side region R as seen from the front of the toilet main unit 2) is set to be larger than the curvature radius r2 (e.g., r2=7 mm) in the other side region (the left side region L as seen from the front of the toilet main unit 2) where no rim spout port 14 is formed (r1>r2).

Similarly, as shown in FIGS. 6 and 7, of the curvature radii s1 and s2 of the curved surfaces S1 and S2 of the outside connecting surface 18 at a position which is left-right symmetrical to the center O of the bowl 10, the curvature radius s1 (e.g., s1=11 mm) in the region on the side where the rim spout port 14 is formed within the side region the bowl 10 (the right side region R as seen from the front of the toilet main unit 2) is set to be larger than the curvature radius s2 (e.g., s2=9 mm) in the other side region (the left side region L as seen from the front of the toilet main unit 2) where no rim spout port 14 is formed (s1>s2).

Similarly, as shown in FIGS. 8 and 9, of the curvature radii t1 and t2 of the curved surfaces T1 and T2 of the outside connecting surface 18 at a position which is left-right symmetrical to the center O of the bowl 10, the curvature radius t1 (e.g., t1=14 mm) in the region on the side where the rim spout port 14 is formed within the side region the bowl 10 (the right side region R as seen from the front of the toilet main unit 2) is set to be larger than the curvature radius t2 (e.g., t2=12 mm) in the other side region (the left side region L as seen from the front of the toilet main unit 2) where no rim spout port 14 is formed (t1>t2).

Next, as shown in FIGS. 4-10, the bowl 10 further includes an inside connecting surface 20 for connecting between the inside edge 6*c* of the shelf 6 and the top edge 4*a* of the waste receiving surface 4 using the curved surfaces R3, R4, S3, S4, T3, T4, and U2. The vertical curvature radii r3, r4, s3, s4, t3, t4, and u2 of the curved surfaces R3, R4, S3, S4, T3, T4, and U2 of this inside connecting surface 20 as seen in vertical elevation are set to increase from the side toward the rear of the bowl 10 (r3<s3<t3<u2; r4<s4<t4<u2).

Here, the curvature radius r3 shown in FIG. 4 is preferably set, for example, at 10 mm-35 mm, and more preferably at 15 mm-25 mm.

Also, the curvature radius s3 shown in FIG. 6 is preferably set, for example, at 20 mm-50 mm, and more preferably at 30 mm-40 mm.

In addition, the curvature radius t3 shown in FIG. 8 is preferably set, for example, at 30 mm-60 mm, and more preferably at 40 mm-50 mm.

Also, the curvature radius u2 shown in FIG. 10 is preferably set, for example, at 40 mm-70 mm, and more preferably at 50 mm-60 mm.

In addition, the curvature radius r4 shown in FIG. 5 is preferably set, for example, at 3 mm-30 mm, and more preferably at 10 mm-20 mm.

Also, the curvature radius s4 shown in FIG. 7 is preferably set, for example, at 15 mm-45 mm, and more preferably at 25 mm-35 mm.

In addition, the curvature radius t4 shown in FIG. 9 is preferably set, for example, at 20 mm-50 mm, and more preferably at 30 mm-40 mm.

Next the operation of a flush toilet 1 according to the above-described first embodiment of the invention is explained as follows.

First, in the flush toilet 1 according to the first embodiment of the invention, flush water spouted rearward from a rim spout port 14 in a rim spout portion disposed on the rim 8 on the left or right side within the front region F of the bowl 10 (the right side region R) is guided in the circumferential direction of the bowl 10 by flowing over the shelf 6, thereby forming a circulating flow.

At this point, as shown in FIGS. 4-10, the widths a1, a2, b1, b2, c1, c2 and d of the shelf 6 are set to decrease from the side to the rear of the bowl 10 ($a1>b1>c1\geq d$; $a2>b2>c2>d$). Therefore when flush water spouted rearward from the rim spout port 14 hits the shelf 6 from the side of the bowl 10, it can flow smoothly from the relatively narrow width shelf 6 into the rear region B within the bowl 10.

Therefore in the rear region B inside the bowl 10 where waste easily adheres and flushing off is difficult, wash down can be sufficiently performed, and flushing performance can be improved.

Next, in a flush toilet 1 according to the present embodiment, the bowl 10 further includes an outside connecting surface 18 which connects between the bottom end 8*a* of the rim 8 and the outside edge 6*b* of the shelf 6 using curved surfaces R1, R2, S1, S2, T1, T2, and U1. Also, the vertical curvature radii r1, r2, s1, s2, t1, t2, and u1 of the curved surfaces R1, R2, S1, S2, T1, T2 and U1 of this outside connecting surface 18 are set to increase from the side toward the rear of the bowl 10 ($r1<s1<t1\leq u1$; $r2<s2<t2<u1$). Therefore when flush water spouted rearward from the rim spout port 14 hits the outside connecting surface 18 at the rear from the side of the bowl 10, it can flow smoothly into the rear region B within the bowl 10 from the shelf 6, particularly where the curvature radius u1 in the vertical direction of the curved surface U1 on the outside connecting surface 18 shown in FIG. 10 is relatively large, and the width d is relatively small.

Therefore in the rear region B inside the bowl 10 where waste easily adheres and flushing off is difficult, wash down can be sufficiently performed, and flushing performance can be effectively improved.

Also, for the vertical curvature radii r1, r2, s1, s2, t1, t2, and u1 of the curved surfaces R1, R2, S1, S2, T1, T2 and U1 of this outside connecting surface 18 at a position which is left-right symmetrical to the center O of the bowl 10, the region on the one side on which the rim spout port 14 is formed within the side region the bowl 10 (the right side region R as seen from the front of the toilet main unit 2) is set to be larger than the region on the other side where no rim spout port 14 is formed (the left region as seen from the front of the toilet main unit 2) ($r1>r2$; $s1>s2$; $t1>t2$).

Thus when flush water spouted rearward from the rim spout port 14 hits the rear region B from the region on one side of the bowl 10 side region (the right side region R and the front region F), it is able to smoothly flow from the relatively narrow-width shelf 6 into the rear region B within the bowl 10.

Therefore in the rear region B inside the bowl 10 where waste easily adheres and flushing off is difficult, wash down can be sufficiently performed, and flushing performance can be more effectively improved.

Moreover, in the flush toilet 1 according to the present embodiment, the bowl 10 further includes an inside connecting surface 20 for connecting between the inside edge 6*c* of the shelf 6 and the top edge 4*a* of the waste receiving surface 4 using the curved surfaces R3, R4, S3, S4, T3, T4, and U2. Also, the vertical curvature radii r3, r4, s3, s4, t3, t4, and u2 of the curved surfaces R3, R4, S3, S4, T3, T4, and U2 of this inside connecting surface 20 are set to increase from the side toward the rear of the bowl 10 ($r3<s3<t3<u2$; $r4<s4<t4<u2$). Therefore when flush water spouted rearward from the rim spout port 14 hits the inside connecting surface 20 at the rear from the side of the bowl 10, it can flow smoothly into the rear region B within the bowl 10 from the shelf 6, particularly in the vertical direction of the curved surface U2 of the inside connecting surface 20 shown in FIG. 10, where the curvature radius u2 is relatively large, and the width is relatively small.

Therefore in the rear region B inside the bowl 10 where waste easily adheres and flushing off is difficult, wash down can be sufficiently performed, and flushing performance can be more reliably improved.

In addition, using the flush toilet 1 of the present embodiment, the shelf 6 includes a sloped surface 6*a* sloping downward from the outside toward the outside of the bowl 10 interior. As shown in FIGS. 4-10, the various slope angles $\alpha1$, $\alpha2$, $\beta1$, $\beta2$, $\gamma1$, $\gamma2$, and $\delta$ of each of the sloped surfaces 6*a* of the shelf 6 are set to increase as the position moves from the side to the rear of the bowl 10 ($\alpha1<\beta1<\gamma1\leq\delta$; $\alpha2<\beta2<\gamma2<\delta$). Thus when flush water spouted rearward from the rim spout port 14 hits the sloped surface 6*a* of the rear shelf 6 from the side of the bowl 10, it is able to flow smoothly into the rear region B within the bowl 10 from the shelf 6 shown in FIG. 10, particularly where the slope angle $\delta$ is relatively large and the width d is relatively narrow.

Therefore in the rear region B inside the bowl 10 where waste easily adheres and flushing off is difficult, wash down can be sufficiently performed, and flushing performance can be more reliably improved.

Next, referring to FIGS. 1 through 18, we explain a flush toilet according to a second embodiment of the invention.

Figure 11:
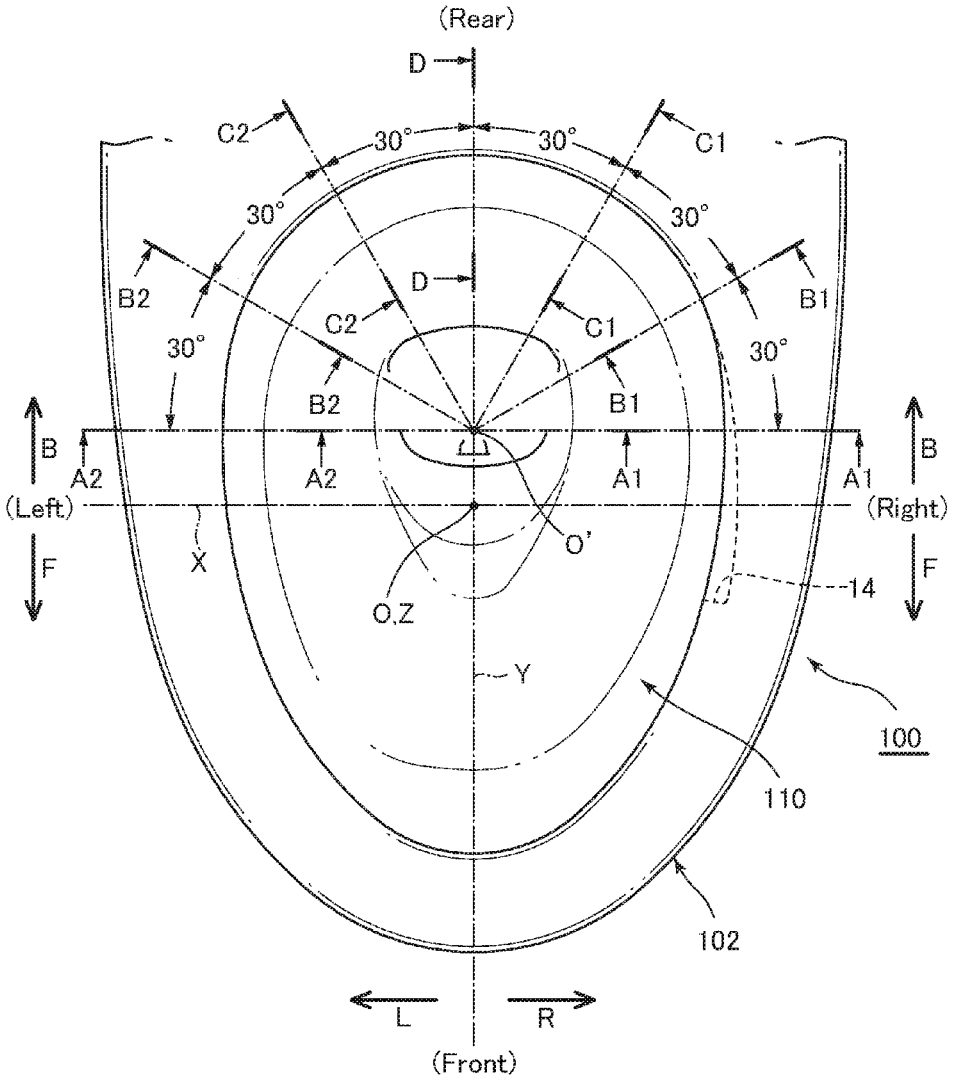
FIG. 11 is a plan view of the main unit of a flush toilet according to a second embodiment of the invention.
Figure 12:
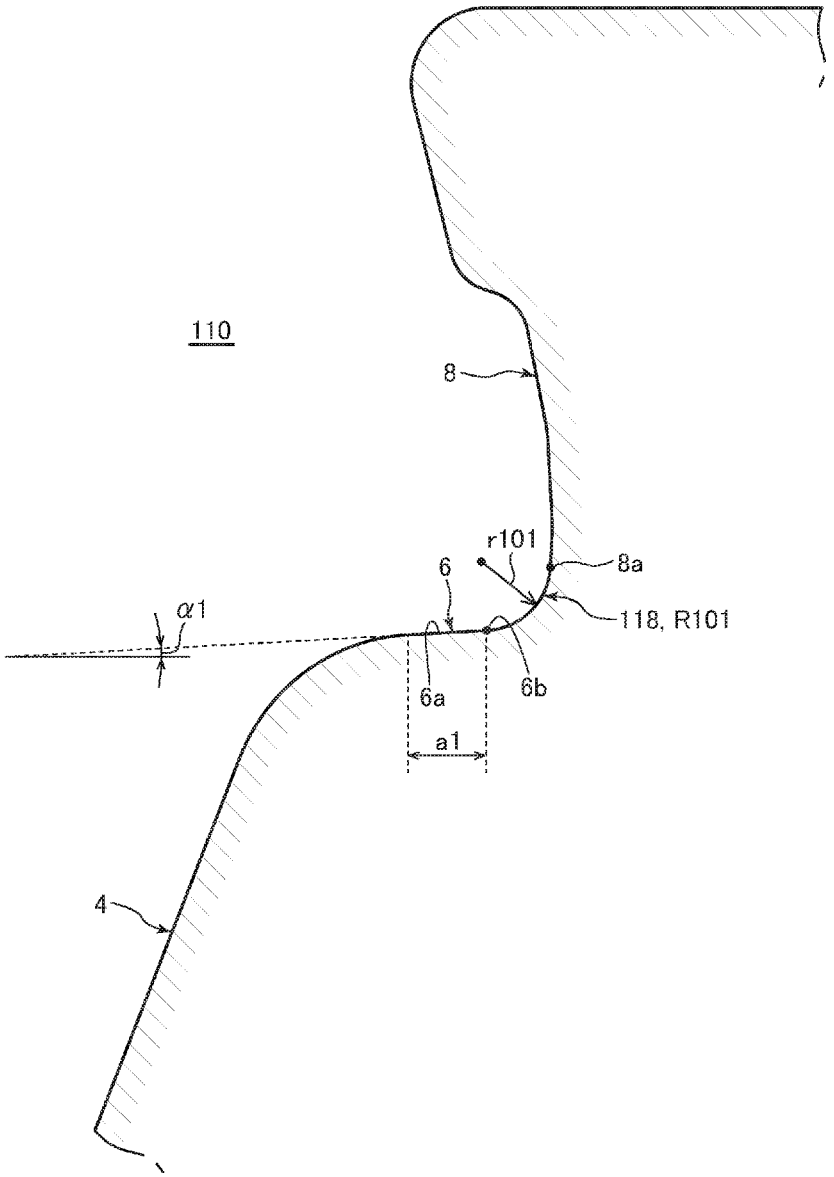
FIG. 12 is a cross section through line A1-A1 in FIG. 11.
Figure 13:
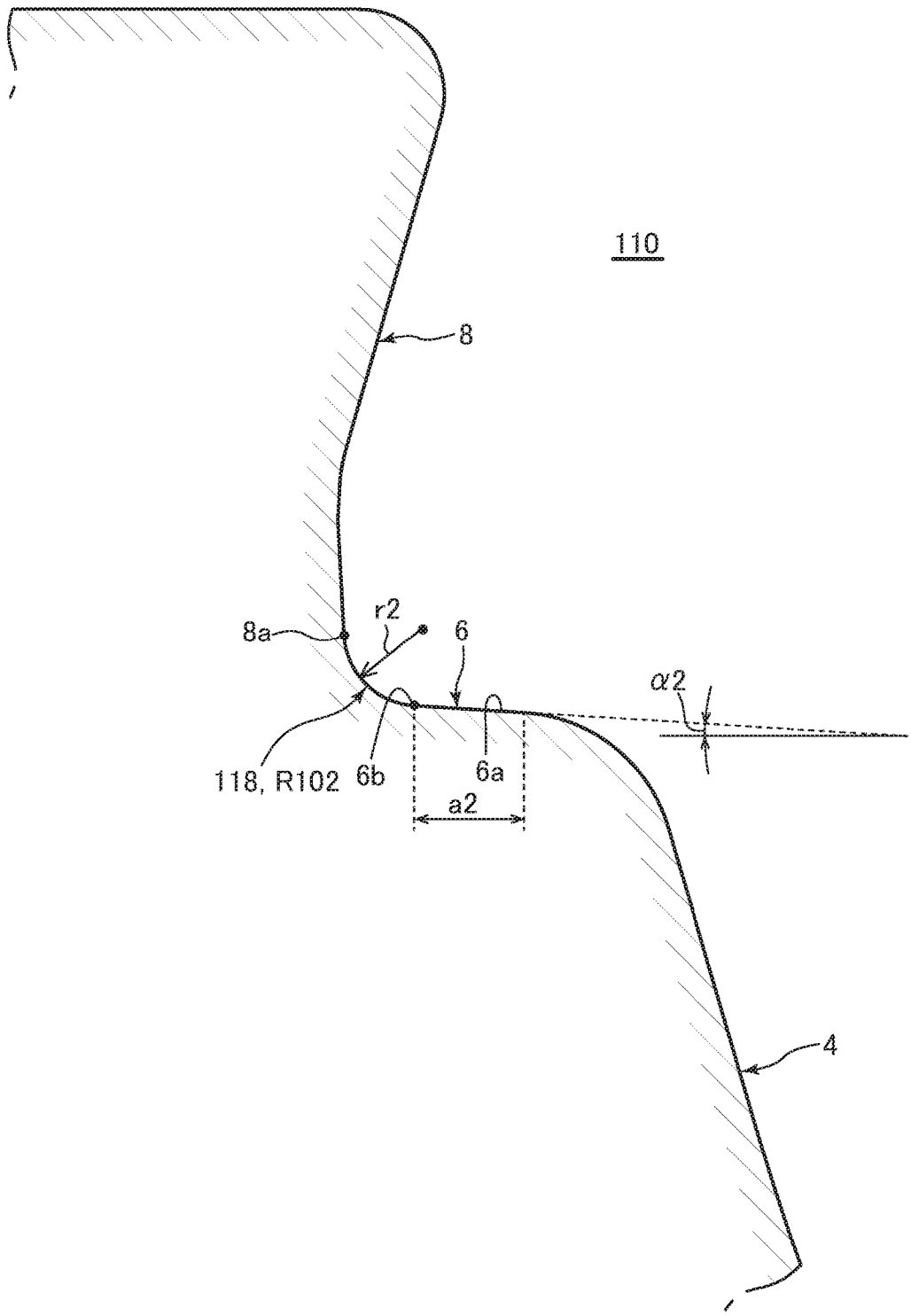
FIG. 13 is a cross section through line A2-A2 in FIG. 11.

First, FIG. 11 is a plan view of the main unit of a flush toilet according to a second embodiment of the invention. FIG. 12 is a cross section through line A1-A1 in FIG. 11. Also, FIG. 13 is a cross section through line A2-A2 in FIG. 11.

Figure 14:
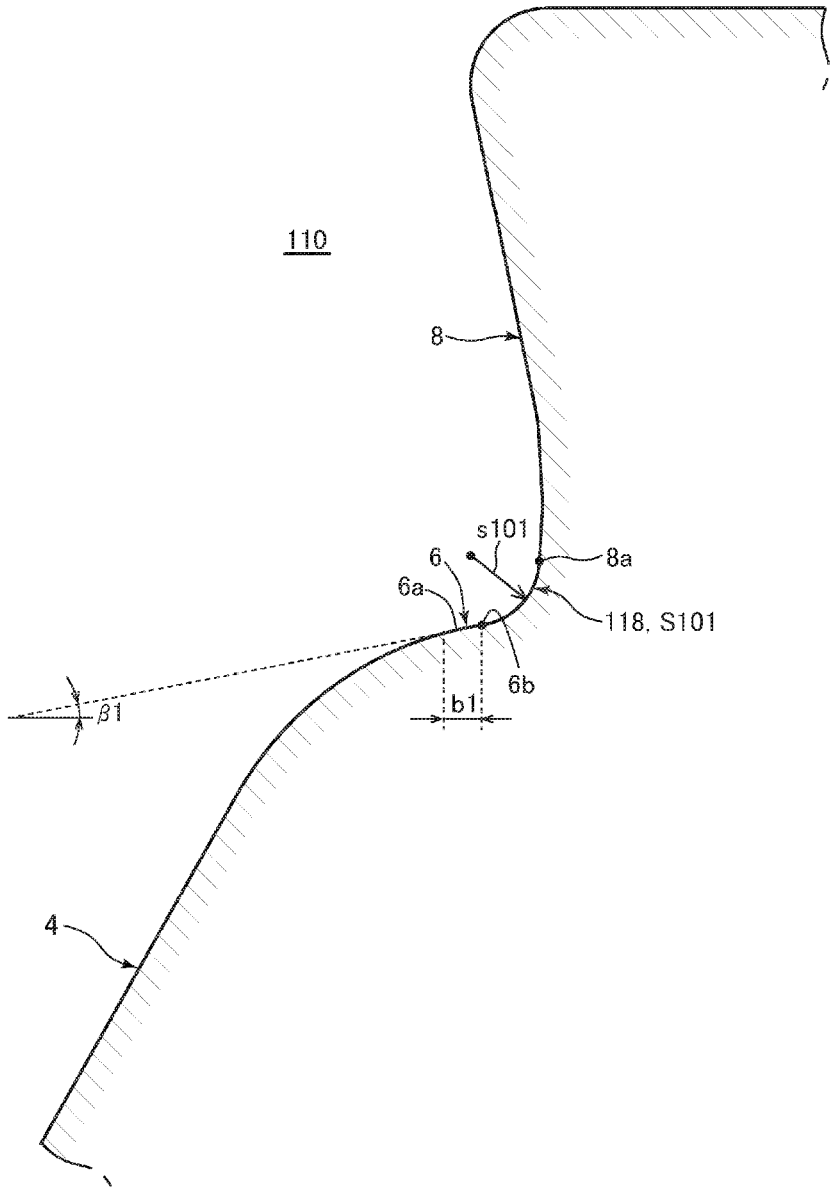
FIG. 14 is a cross section through line B1-B1 in FIG. 11.
Figure 15:
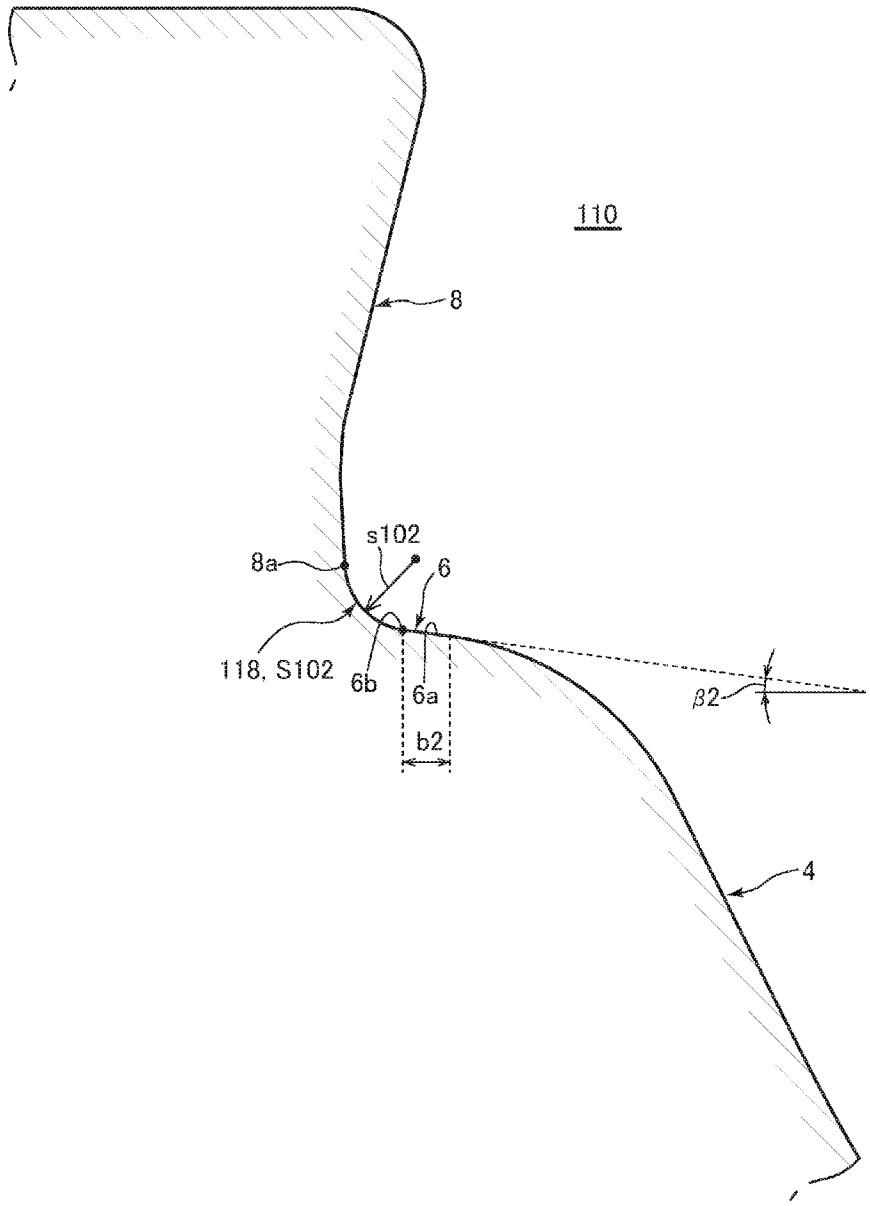
FIG. 15 is a cross section through line B2-B2 in FIG. 11.

Next, FIG. 14 is a cross section through line B1-B1 in FIG. 11. FIG. 15 is a cross section through line B2-B2 in FIG. 11.

Figure 16:
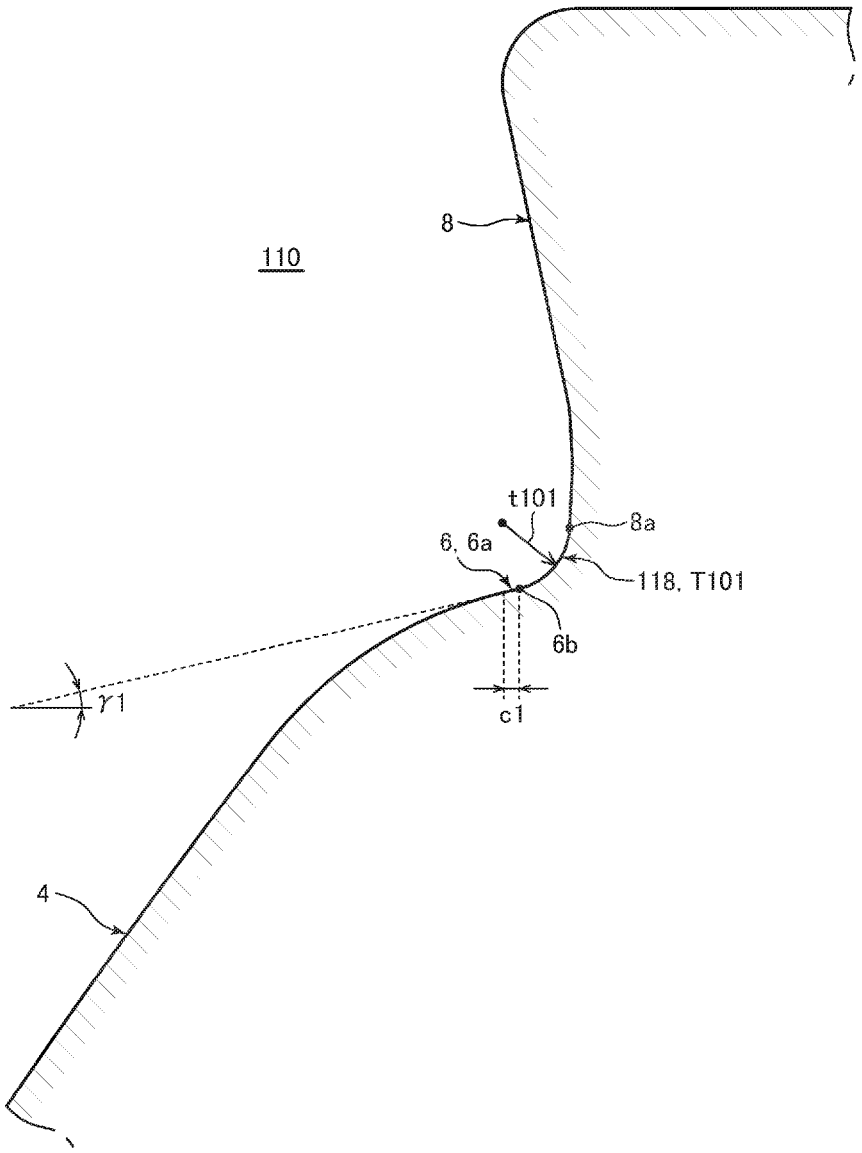
FIG. 16 is a cross section through line C1-C1 in FIG. 11.
Figure 17:
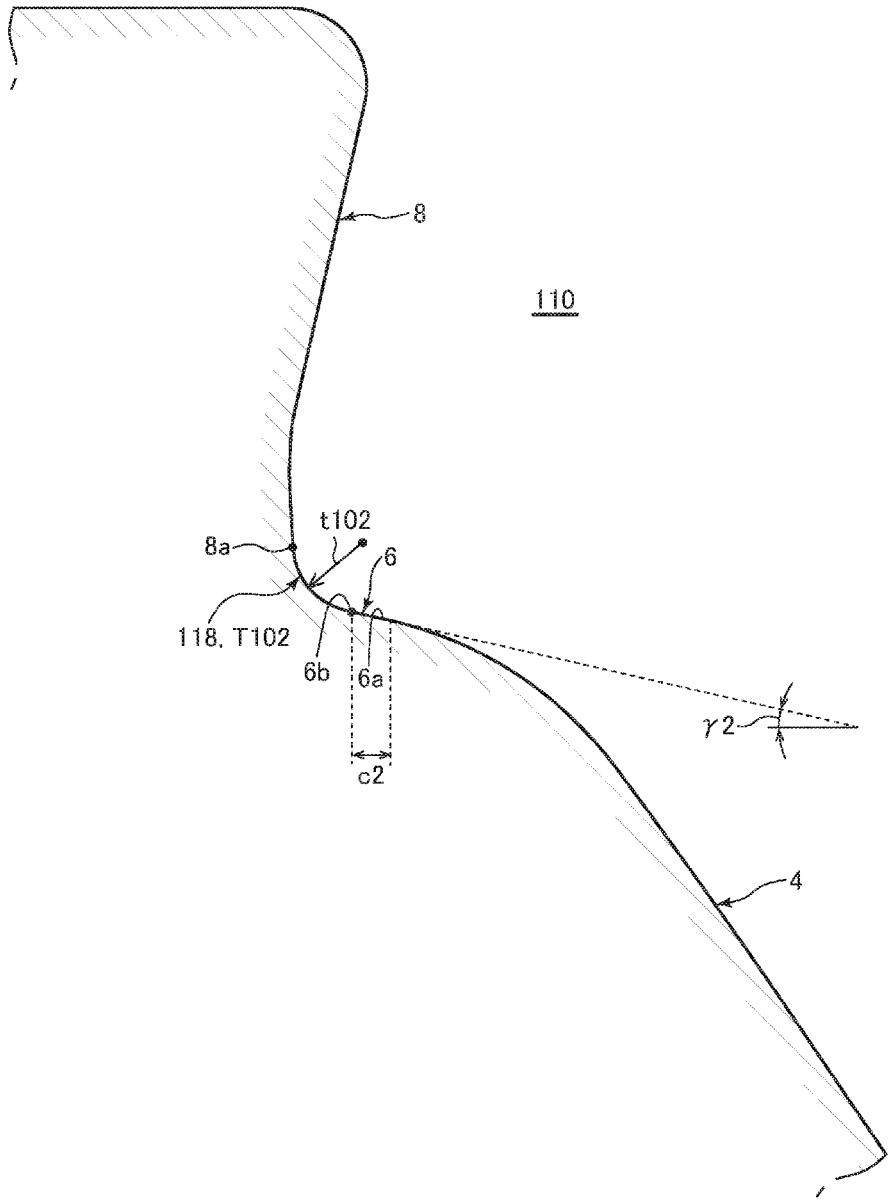
FIG. 17 is a cross section through line C2-C2 in FIG. 11.

In addition, FIG. 16 is a cross section through line C1-C1 in FIG. 11. FIG. 17 is a cross section through line C2-C2 in FIG. 11.

Figure 18:
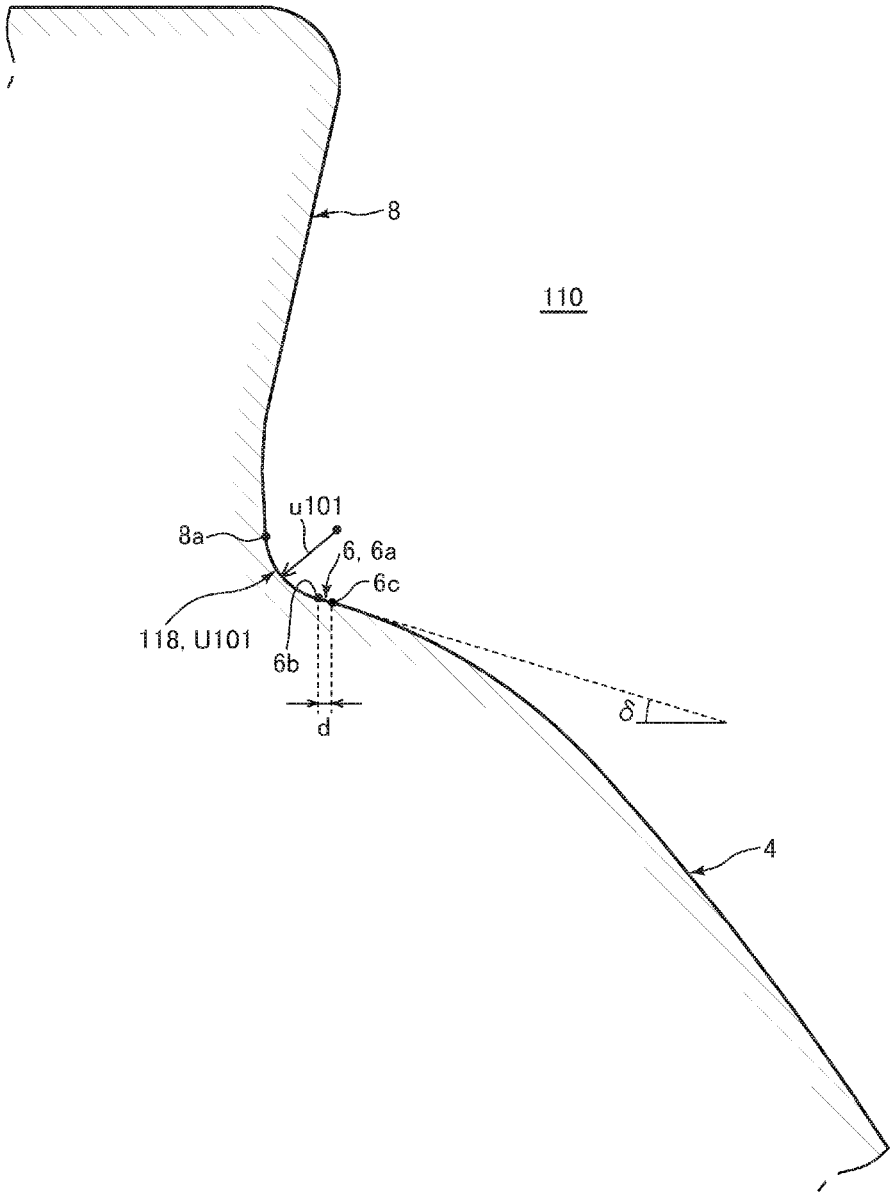
FIG. 18 is a cross section through line D-D in FIG. 11.

Also, FIG. 18 is a cross section through line D-D in FIG. 11.

Here, in the flush toilet according to the second embodiment of the present invention shown in FIGS. 11-18, the same reference numerals are assigned to parts which are the same as in the flush toilet 1 according to the first embodiment of the present invention shown in FIGS. 1-10, so an explanation thereof is here omitted.

First, as shown in FIGS. 11-18, the flush toilet 100 according to the second embodiment of the invention is the same as the above-described flush toilet 1 according to a first embodiment of the invention shown in FIGS. 1-10 water in that the shelf 6 widths a1, a2, b1, b2, c1, c2, and d corresponding to the cosine component lengths of each sloped surface 6*a* of the shelf 6 are set to decrease from the side toward the rear of the bowl 110 ($a1>b1>c1\geq d$; $a2>b2>c2>d$).

However, in the flush toilet 100 according to the second embodiment of the invention, at the outside connecting surface 118 connecting each of the curved surfaces R101, R102, S101, S102, T101, T102, and U101 between the bottom end 8*a* of the rim 8 and the outside edge 6*b* of the shelf 6 of the bowl 110, the curvature radii r101, r102, s101, s102, t101, t102, and u101 in the vertical direction of the curved surfaces R101, R102, S101, S102, T101, T102, and U101 are set to be essentially constant from the side to the rear of the bowl 110, and in this aspect form a different structure to that of the flush toilet 1 according the above-described first embodiment.

Also, the meaning of "essentially constant" with respect to curvature radii r101, r102, s101, s102, t101, t102, and u101 includes the meaning of "generally constant," such that when flush water spouted rearward from the rim spout port 14 hits the rear outside connecting surface 118 from the side of the bowl 110, it is able to flow smoothly from the shelf 6 into the rear region B within the bowl 110.

Here it is preferable to set a dimension of 3 mm-15 mm, and more preferably 5 mm-10 mm, as the curvature radii r101, r102, s101, s102, t101, t102, and u101 in the vertical direction of the curved surfaces R101, R102, S101, S102, T101, T102, and U101.

In a flush toilet 100 according to the above-described second embodiment of the invention, the bowl 110 further includes an outside connecting surface 118 which connects between the bottom end 8*a* of the rim 8 and the outside edge 6*b* of the shelf 6 using curved surfaces R101, R102, S101, S102, T101, T102, and U101. The curvature radii r101, r102, s101, S102, t101, t102, and u101 in the vertical direction of the curved surfaces R101, R102, S101, S102, T101, T102, and U101 in this outside connecting surface 118 are set to be essentially constant from the side to the rear of the bowl 110. For this reason, when flush water is spouted rearward from the rim spout port 14 and hits the rear outside connecting surface 118 from the side of the bowl 110, it is able to flow smoothly into the rear region B within the bowl 110 from the relatively narrow width shelf 6 at essentially the constant radii r101, r102, s101, S102, t101, t102, and u101 in the vertical direction of the curved surfaces R101, R102, S101, S102, T101, T102, and U101 of the outside connecting surface 118.

Therefore in the rear region B inside the bowl 110 where waste easily adheres and flushing is difficult, wash down can be sufficiently performed while maintaining the size of the bowl 110, and flushing performance can be effectively improved.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet configured to discharge waste by flushing the flush toilet with flush water supplied from a flush water source, the flush toilet comprising:

a bowl which includes a rim formed at a top edge of the bowl, a bowl-shaped waste receiving surface, and a shelf formed between the bowl-shaped waste receiving surface and the rim;

a discharge path configured to discharge waste, the discharge path being connected to a bottom of the bowl; and a rim spout portion disposed on the rim, the rim spout portion being configured to spout the flush water onto the shelf in the bowl so as to form a circulating flow;

wherein the shelf is formed between a top edge of the waste receiving surface and a bottom end of the rim and in a circumferential direction from the rim spout portion, the shelf being configured to guide the flush water spouted from the rim spout portion in the circumferential direction;

the rim spout portion includes a single rim spout port disposed on a front-side region of the bowl, the single rim spout port being arranged to open rearward so as to be able to spout flush water rearward;

a width of the shelf is set to decrease from one side of the bowl, in which the single rim spout port is disposed, to a rear end of the bowl, and the width of the shelf is then set to increase from the rear end of the bowl to other side of the bowl;

the bowl further includes an outside connecting surface configured to connect between an outside edge of the shelf and the bottom end of the rim by a curved surface; and a curvature radius of the curved surface of the outside connecting surface in a vertical direction is set to increase from the one side of the bowl, in which the single rim spout port is disposed, to the rear end of the bowl, and the curvature radius is then set to decrease from the rear end of the bowl to the other side of the bowl.

2. The flush toilet according to claim 1, wherein in the curvature radius in the vertical direction of the outside connecting surface at a position which is left-right symmetrical to a center of the bowl, the curvature radius of the outside connecting surface in the one side of the bowl, in which the single rim spout port is disposed, is larger than the curvature radius of the outside connecting surface in the other side of the bowl, in which the single rim spout port is not disposed.

3. The flush toilet according to claim 1, wherein the bowl further includes an inside connecting surface configured to connect between an inside edge of the shelf and the top edge of the waste receiving surface by a curved surface, and a curvature radius of the curved surface of the inside connecting surface in the vertical direction is set to increase from the side to a rear of the bowl.

4. The flush toilet according to claim 1, wherein the shelf includes a sloped surface sloping downward from an outside toward an inside of the bowl, and a slope angle of the sloped surface is set to increase from the side to a rear of the bowl.

* * * * *